United States Patent [19]

Kade

[11] Patent Number: 4,980,026

[45] Date of Patent: Dec. 25, 1990

[54] HEADBOX WITH MOVABLE DUCT WALL

[75] Inventor: Werner Kade, Heidenheim, Fed. Rep. of Germany

[73] Assignee: J. M. Voith GmbH, Fed. Rep. of Germany

[21] Appl. No.: 424,670

[22] Filed: Oct. 20, 1989

[30] Foreign Application Priority Data

Oct. 22, 1988 [DE] Fed. Rep. of Germany ..... 3836062

[51] Int. Cl.[5] ..... D21F 1/02

[52] U.S. Cl. ..... 162/336; 162/344; 162/347

[58] Field of Search ..... 162/336, 347, 344, 340, 162/339

[56] References Cited

U.S. PATENT DOCUMENTS

| | | | |
|---|---|---|---|
| 3,738,910 | 6/1973 | Noyer | 162/347 |
| 3,769,154 | 10/1973 | Wolf | 162/340 |
| 4,770,745 | 9/1988 | Hildebrand et al. | 162/336 |

FOREIGN PATENT DOCUMENTS

| | | |
|---|---|---|
| 1461176 | 2/1971 | Fed. Rep. of Germany . |
| 2117770 | 9/1981 | Fed. Rep. of Germany . |
| 3535849 | 4/1987 | Fed. Rep. of Germany . |
| 1361083 | 7/1974 | United Kingdom . |

*Primary Examiner*—Karen M. Hastings
*Assistant Examiner*—Laura L. Miles
*Attorney, Agent, or Firm*—Ostrolenk, Faber, Gerb & Soffen

[57] ABSTRACT

A headbox for stock suspension for a machine for forming a web from the stock suspension. The headbox having an outlet duct formed by a relatively stationary duct wall below and a relatively movable duct wall above. The duct walls converge in the direction of suspension flow to form an outlet slot. The upper duct wall is pivoted at its upstream end to enable adjustment of the clear width, i.e. the inter-wall spacing of the outlet slot. A beam extends across the machine above the movable duct wall. A pressurizable back pressure cushion is disposed between the beam and the movable duct wall. The pressure of the cushion is adjustable for maintaining the desired pressure level exerted by the movable wall on the stock suspension in the outlet slot. A lifting appliance is connected with the beam, but not with the movable duct wall, for adjusting the height position of the beam, which adjusts the width of the pressurized outlet slot.

21 Claims, 2 Drawing Sheets

HEADBOX WITH MOVABLE DUCT WALL

BACKGROUND OF THE INVENTION

The present invention relates to a headbox for a machine for the manufacture of fibrous webs made from a stock suspension, and more particularly for the manufacture of paper webs. The headbox is of the type having a machine wide outlet duct bordered by two duct walls, respectively located above and below, and converging in the direction of flow of suspension to form an outlet slot in the downstream region. One duct wall is movably supported, and is preferably pivotally supported at its upstream end, so that the clear width of the outlet slot can be varied by means of a lifting appliance. A beam extends across the width of the machine adjacent to the adjustable duct wall. A back pressure cushion is disposed between the duct wall and said beam.

Headboxes of this type are known from German Patent Specification No. 1,461,176 and from Austrian Patent Specification No. 309,973, which corresponds to British Patent Specification No. 1,361,083.

A major problem with such headboxes is keeping the clear width, i.e. the height between the duct walls, of the outlet slot uniform with the greatest possible accuracy over the entire machine width. In practice, it has been shown that local deviations in the desired outlet slot width impairs the quality of the resulting paper web Investigations have shown that a W-shaped or M-shaped profile of the cross section of the outlet slot is usually found, which produces a corresponding irregular "weight per unit area transverse cross section" (usually called "cross direction profile of the basis weight") of the paper web It has also been shown that a certain error in the slot width of the outlet slot can cause a ten fold error in the basis weight of the paper web.

A further difficulty is that certain changes in slot width occur during the operation of the paper making machine and these do not usually disappear altogether. Such temporary, normally local, changes in slot width are caused in particular by fluctuations in the temperatures inside the paper making machine, on the one hand, and in the ambient environment, on the other hand. Fluctuations in temperature inside the paper making machine occur especially if the production cycle is interrupted, because in that case, different machine parts and the stock suspension have different temperatures. The temperature of the stock suspension is normally between 30° C. and 60° C., or more, depending upon the grade of paper. In operation, the interior of the adjustable duct wall adapts to this stock temperature, while the exterior of that wall and the beam are exposed to a fluctuating ambient temperature. This causes thermal stresses, from which undesirable deformations of the wall result.

With the headboxes specified in German Patent Specification No. 1,461,176 and Austrian Patent Specification No. 309,973, the adjustable duct wall, which determines the outlet slot, and to which the beam is rigidly attached, is supported at both axial ends, i.e. at the front side and at the drive side of the machine, on the lifting appliance. Fixed end moments, which also have an undesirable effect on the contours of the movable duct wall, result from this type of support. This occurs because the loading of the movable duct wall originating from the pressure of the stock suspension is substantially uniformly distributed over its length, i.e. over the machine width. However, in the opposite direction, the loading of the movable duct wall is composed of a uniformly distributed load produced by the back pressure cushion and from single loads, produced by the lifting appliance, and from the aforementioned fixed end moments. Thus, it is not possible to obtain satisfactory results with the back pressure cushion alone.

Repeated attempts have been made to improve the uniformity of the outlet slot width by additional measures. More particularly, a deformable component, e.g. a profile bar, is provided at the outlet slot. This can be adjusted by means of a plurality of spindles which are regularly spaced over the machine width. However, it is again not possible to obtain with sufficient accuracy a rectilinear contour of the edge of the movable duct wall limiting the outlet slot across the full machine width. In any case, the accuracy previously attained is frequently not sufficient to meet current requirements for paper quality.

SUMMARY OF THE INVENTION

The object of the present invention is to eliminate the aforementioned shortcomings which result from mechanical and thermal stresses and deformations, so that the clear width of the outlet slot can be kept constant over the machine width, with greater accuracy than before.

Another object is to keep the contour of at least the movable duct wall, when seen in cross section, exactly rectilinear as far as possible, not just directly at the outer slot, but also upstream from that slot.

The movable duct wall, here preferably the upper duct wall, is in pressure communication with the beam through a pressure cushion between them. As specified herein, the crux of the present invention lies in mechanically uncoupling the movable duct wall and the beam so that the movable duct wall practically floats on the stock suspension during the normal operation of the headbox. The movable duct wall is forced by the pressure of the stock suspension against the back pressure cushion. This causes the position of the duct wall to be determined just by the pressure prevailing in the two "cushions" and by its weight.

The back pressure cushion may be comprised of a hose which can be acted on by compressed air or by hydraulic fluid, so that a force directed against the pressure of the suspension acts on the exterior of the adjustable, movable duct wall.

The movable duct wall and the likewise movable beam are independently guided, and are preferably pivotally attached, in stationary parts of the headbox. The movable duct wall and the beam are consequently not connected to one another. In the subsequent parts of the specification, it is understood that the movable duct wall and the beam are pivotally mounted. However, this is not necessary for every embodiment of the invention.

According to a preferred exemplified embodiment, the separate pivot axes of the movable duct wall and of the beam are parallel and at least almost coaxial with one another, so that when the duct wall and the beam pivot together, it is possible to avoid a deformation of the hose which forms the back pressure cushion.

In order that the back pressure in the back pressure cushion, i.e. in the hose, might always be correct and correspond to the pressure of the stock suspension, a pressure control device controls the back pressure in the back pressure cushion as a function of the current pressure of the stock suspension. For this purpose, the pressure control device is connected to a pressure sensor, which measures the current pressure of the stock suspension in the outlet duct. Alternatively or additionally, a known measuring device may be provided for the outlet slot width and a regulating device may be provided to keep the outlet slot width constant over time.

The adjustable, movable duct wall and the beam are two independent structural parts. In order to treat both structural parts as a single unit when opening the outlet duct and for maintenance and cleaning purposes, jaw components loosely couple the beam with the adjustable duct wall. These jaw components are designed and dimensioned so that the adjustable duct wall and the beam have adequate clearance for relative movement.

With known headboxes, the lifting appliance which helps to support the movable duct wall and to adjust the clear width of the outlet slot is disposed so that the supporting forces apply considerable force upon the swivel axis of the adjustable duct wall. This force may also cause unwanted deformations of the duct wall. With the invention, the swivel axis of the adjustable duct wall is to a large extent stress free because the lifting appliance acts not on the duct wall, but acts on the beam instead, and also because the back pressure cushion is disposed largely symmetrically to the surface of the movable duct wall in contact with the stock. The following situation results. The pressure forces acting on the movable duct wall, which result from the pressure of the suspension from below and from the back pressure cushion from above, lie substantially in the same effective curve and are opposed to one another. They are consequently balanced As a result, the swivel bearing at the pivot bearing of the movable duct wall is largely stress free.

In a further refinement of the present invention, the lifting appliance is so disposed and is so coupled with the beam that, as seen in the longitudinal direction, the effective direction of the lifting appliance lies at least approximately in the effective curve of the compressive force which forces the back pressure cushion onto the beam. As a result, the load on the swivel bearing at the pivot axis of the beam can also be considerably reduced.

The movable duct wall may be manufactured from a metallic material, and preferably from high grade steel. However, in order to even further reduce the risk of the deformation that is caused by thermal stresses, the movable duct wall may be manufactured from a material having a coefficient of thermal expansion of approximately zero, for example from a carbon fiber reinforced plastic. In a preferred refinement of the invention, the opposite relatively non-movable duct wall may also be made from such a material.

In addition to the advantages already mentioned, the invention also has advantages which are associated with its manufacture. These advantages are attributed to the fact that the beam and the adjustable duct wall are separate elements. Production is consequently simplified and made cheaper. In the event of damage, it is not necessary to repair or exchange the entire unit, as previously was the case, but just the damaged part.

Because the adjustable duct wall is a "floating element", this has the associated advantage that the characteristic frequency of the duct wall is clearly higher than with known constructions. As a result, the risk that oscillations may impair the longitudinal profile of the basis weight of the paper web is removed.

German Patent Specification No. 2,117,770 discloses a headbox for a paper making machine in which, at the movable duct wall, the pressure of the suspension is balanced by the pressure in a back pressure chamber, and in which the movable duct wall floats on the stream of stock suspension. However, in this specification, the back pressure chamber is bordered on the outside by stationary walls, so that it is not possible to move the movable duct wall in the upward direction to a sufficient degree, e.g. for cleaning purposes.

Other objects and features of the invention are explained below by reference to the drawings.

DESCRIPTION OF A PREFERRED EMBODIMENT

Figure 1:
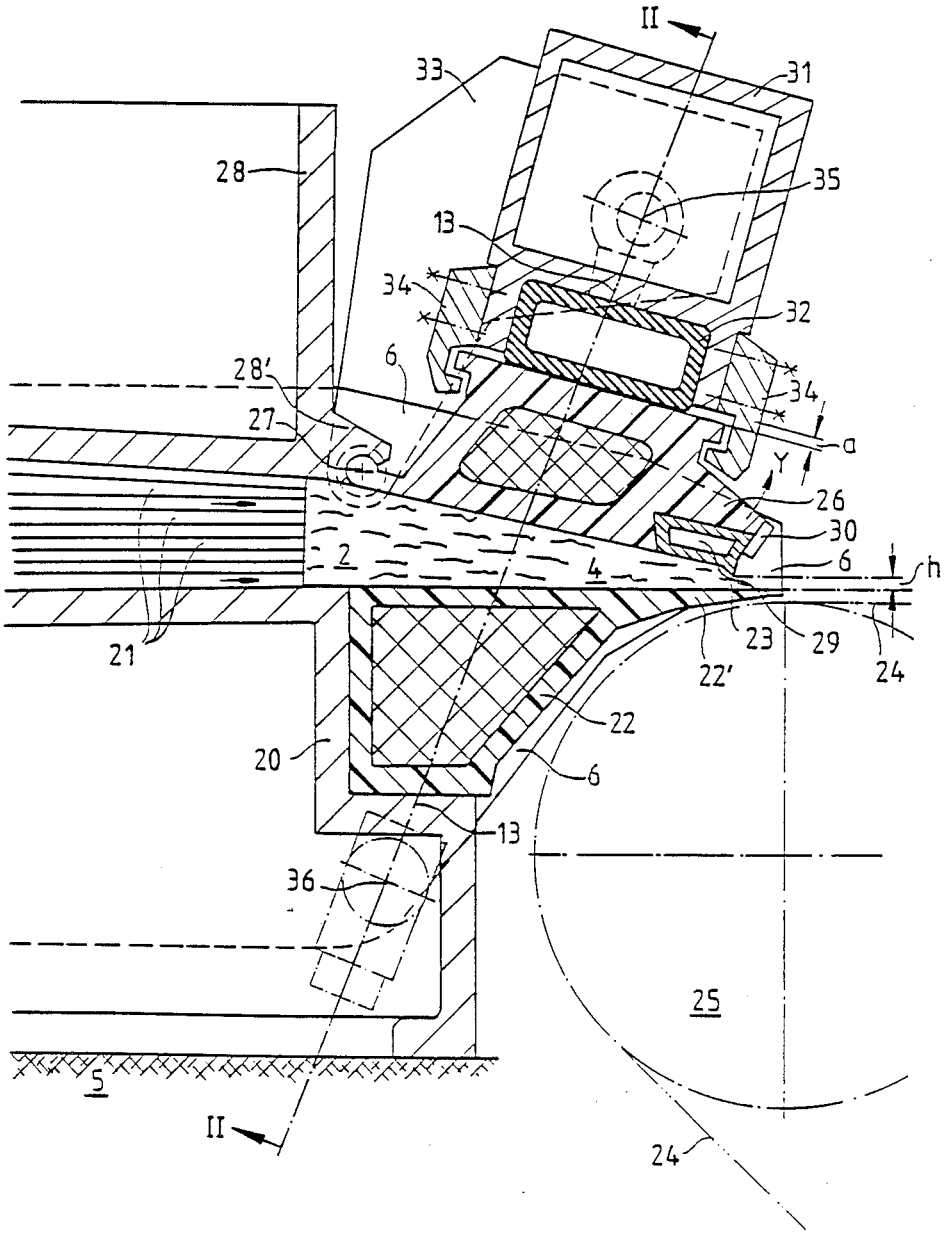
FIG. 1 is a partial longitudinal cross sectional view through a headbox including the invention.

The headbox shown has a lower support member 20, which rests on a bedplate 5, and an upper support member 28, which is substantially connected to the lower support member 20 via two axially spaced apart, lateral walls 6. Between the two support members 20 and 28 is disposed a bank of fine, i.e. small bore, fiber suspension distribution tubes 21. An outlet duct 4, which tapers toward an outlet slot 23 in the downstream flow direction, is formed by a lower, stationary duct wall 22 and by an upper movable duct wall 26. The movable wall 26 is pivoted at its upstream region in a projection 28' on the upper support member 28 by means of a pivot axis 27. It can therefore be pivoted around this axis 27, as indicated by arrow Y.

The outlet duct 4 is bordered at the downstream end of the adjustable duct wall 26 by an axially elongate, expandable member 29, which is inserted in a corresponding recess in the adjustable duct wall 26 and is held in place there by a bracket plate 30. An expandable member 29 of this type is proposed in a previous German Patent Application No. P 37 28 387.1. It is possible with the member 29 to adjust its edge which borders the outlet slot 23 with great sensitivity. With a slightly modified shape of the duct wall 26, not shown, a known profile bar can be provided instead of the expandable member 29.

The outlet duct 4 is bordered laterally by the lateral walls 6. The stock suspension flowing through the outlet duct 4 exerts an upwardly directed compressive force on the upper movable duct wall 26. This compressive force counteracts the force of a back pressure cushion 32, which is disposed between the upper side of the movable duct wall 26 and a beam 31. That beam can also be moved. The back pressure cushion 32 is formed by a rectangular hose, which is supported in one plane on the adjustable duct wall 36. Its opposite surface is inserted in a corresponding complementary shaped recess in the beam 31. The hose 32 is pneumatically or hydraulically pressure loaded. It thus transmits the force resulting from the pressure of the suspension and acting on the adjustable duct wall 26 to the beam 31 This simultaneously guarantees that an adequate space remains, e.g. at a, between the beam 31 and the adjustable duct wall 26 so that both move relative to one another.

The beam 31 is securely connected to two levers 33. These are pivoted on respective journals 41', which rest in bearing brackets 41 that are coaxial with the swivel axis 27. Consequently, the beam 31 and the adjustable duct wall 26 can swivel around the same swivel axis, so that the bearing surfaces of the hose 32, which are parallel to one another, remain substantially parallel to one another, throughout the whole operation. However, it should be noted that the pivot axes for the beam 31 and the adjustable duct wall 26 do not have to be exactly coaxial. For the headbox to perform as required, it suffices if the pivot axes are at least approximately coaxial with one another.

If required, the headbox shown may be modified in a manner not shown in the drawings. The pivot axis 27 and the bearing brackets 41 with journals 41' may be roughly horizontally displaceable together. As a result, the adjustable, movable, upper duct wall 26, together with the beam 31, may be displaced in the direction of suspension flow relative to the stationary duct wall 22, a displacement known from U.S. Pat. No. 3,738,910.

To enable the pivoting of the adjustable duct wall 26 and the beam 31 upward as a single unit, so as to open the outlet duct 4 for the purpose of inspection or cleaning, claw components 34 are attached laterally to the beam 31 and loosely grip via corresponding claw projections on the adjustable duct wall 26. The claw components 34 must not restrict the clearance between the beam 31 and the adjustable duct wall 26 during operation, i.e. they must be kept far enough from the outer contours of the adjustable duct wall 26.

Regarded functionally, with reference to FIG. 1, at the beginning of a production cycle the clear width h, i.e. the height between the duct walls, of the outlet slot 23 has to be adjusted. For this purpose, a lifting appliance 13 is provided which is partly illustrated, but only symbolically, by thick dot-dash lines. The lifting appliance 13 includes two worm gear spindles, for example, which are connected by hinges 35 to the beam 31 and are supported on the lower support member 20 by hinges 36 with bearing brackets 40. If the beam 31 is pivoted via its swivel axis, then the correct clear width h of the outlet slot 23 is also set by means of the back pressure cushion 32 if the correct back pressure is regulated in the back pressure cushion.

FIG. 1 shows that the effective direction of the lifting appliance 13 acting on the beam 31 is such that the sum of the forces acting on the beam 31 is at least approximately zero, i.e. the force of the lifting appliance and the effect of gravity on the beam 31 compensate for the compressive force that is exerted upward by the back pressure cushion 32.

The two worm gear spindles of the lifting appliance 13 may be normally driven by a common motor and by a transverse shaft, not shown. Alternatively, two separate motors and a regulating device, as specified in German Published Application No. OS 35 35 849, may also be provided.

At least one and preferably the two duct walls 22 and 26 are preferably made from plastic, e.g. carbon fiber reinforced plastic, which has an extremely low coefficient of thermal expansion. As shown in the drawings, the two duct walls 22 and 26 may have cavities in which fine low-weight reinforcing elements, e.g. vertical bars or honeycomb structures, are disposed.

Figure 2:
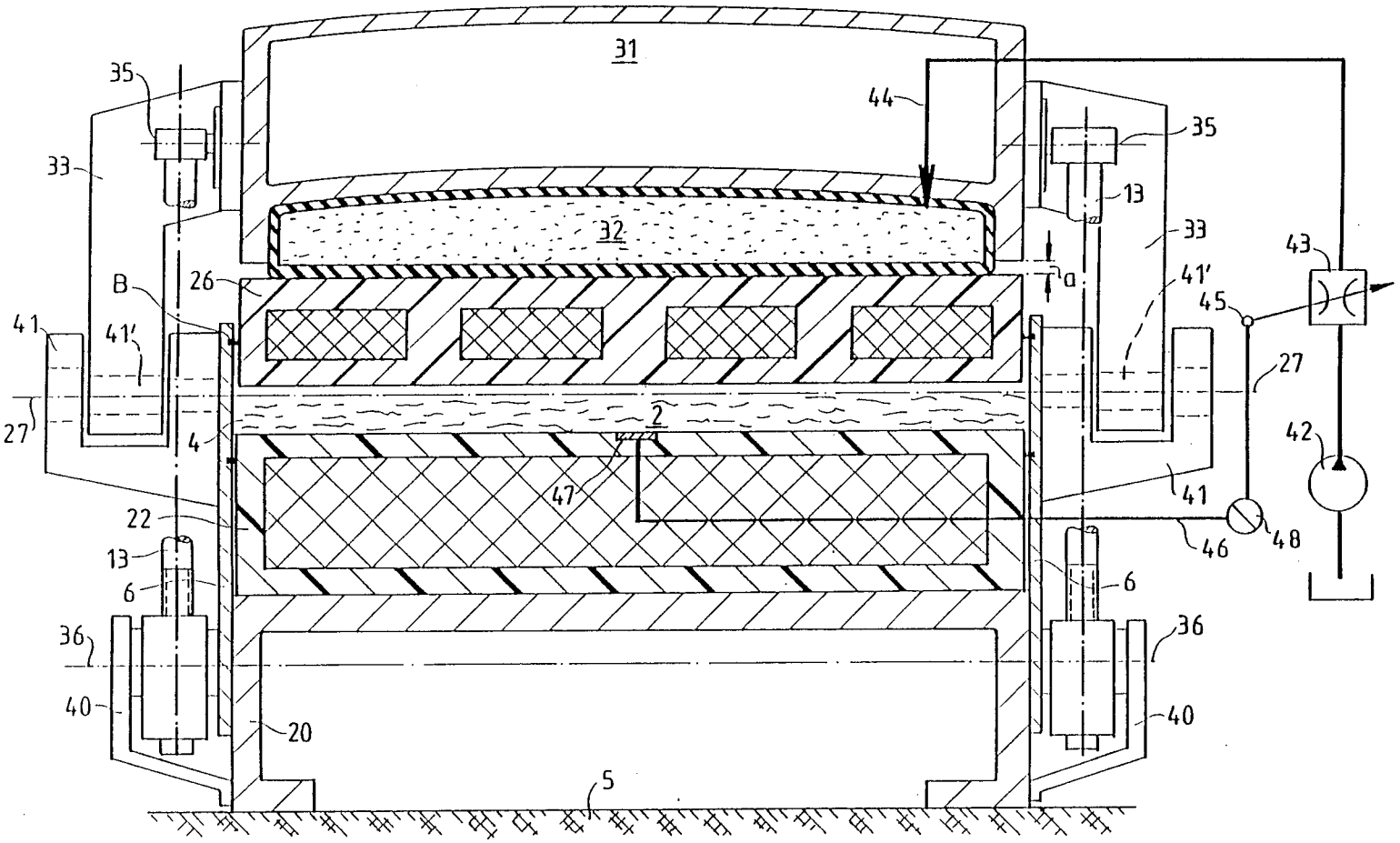
FIG. 2 shows a cross section along line II—II of FIG. 1.

FIG. 2 shows how the adjustable duct wall 26 abuts the back pressure cushion 32 and floats with respect to the beam 31. The upward deflection of this beam 31 is shown exaggerated.

Slots which have to be sealed by seals B, for example, are located between the lateral walls 6, on the one hand, and the duct walls 22 and 26, on the other hand.

A control appliance for the pressure required in the back pressure cushion 32 comprises a pressure medium pump 42, e.g. a hydraulic oil pump, which is connected via a throttle valve 43 and a pressure medium line 44 to the interior of the hose forming the back pressure cushion 32. The throttle valve 43 has a control input 45, which, via a transducer 48 and a control line 46, is connected to a pressure sensor 47. The sensor 47, in turn, is disposed in the surface of the stationary duct wall 22. The sensor measures the pressure of the stock suspension 2 prevailing in the outlet duct 4.

Consequently, depending upon the pressure prevailing in the stock suspension 2 in the outlet duct 4, the transducer 48 transmits a control signal for the throttle valve 43, which regulates the pressure in the back pressure cushion 32.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A headbox for a machine for the manufacture of fibrous webs from stock suspension, the headbox comprising:

the headbox including means for holding stock suspension; an outlet duct from the headbox, the outlet duct comprising first and second spaced apart duct walls oriented to extend across the width of the machine and across the direction of suspension flow and to form between the walls an outlet slot from the headbox at the ends the walls downstream in the direction of suspension flow;

the first wall being fixed against relative movement with respect to the second wall; the second wall being supported for being movable relative to the first wall for varying the clear width between the walls of the outlet slot at the downstream end thereof through movement of the second wall toward and away from the first wall at the downstream end of the outlet slot;

a beam extending across the width of the machine, located near the second, movable wall of the outlet duct; the beam also being supported for being movable relative to the first duct wall and also relative to the second duct wall and movable toward and away from the duct walls;

a back pressure cushion disposed between the relatively movable second duct wall and the beam, the cushion being pressurizable, for exerting force upon the second duct wall and the beam between which it is disposed;

a lifting appliance at the headbox connected with the beam for selectively lifting the beam away from the second duct wall, and the lifting appliance being out of engagement with the second duct wall, the headbox being structured and arranged so that the second duct wall moves with respect to the beam independently of the operation of the lifting appliance upon the beam.

2. The headbox of claim 1, wherein the second duct wall is disposed above the first duct wall and the beam is disposed above the second duct wall.

3. The headbox of claim 2, wherein the pressure cushion extends across the width of the machine.

4. The headbox of claim 2, wherein the first and second walls of the outlet duct converge together in the flow direction of the suspension such that the clear width of the outlet slot narrows in the flow direction.

5. The headbox of claim 4, wherein the second duct wall is pivotally mounted at the headbox for pivotally moving with respect to the first wall and the beam.

6. The headbox of claim 5, wherein the second duct wall has an upstream end region which is upstream of and away from the downstream end of the second duct wall, and the second duct wall is pivotally mounted at the upstream end portion thereof.

7. The headbox of claim 5, wherein the beam is pivotally mounted at the headbox for pivoting relative to the second duct wall, and the beam is independently pivotable with respect to the second duct wall.

8. The headbox of claim 2, wherein the beam is pivotally mounted at the headbox for pivoting relative to the second duct wall, and the beam is independently pivotable with respect to the second duct wall.

9. The headbox of claim 3, wherein the back pressure cushion comprises a pressure loaded flexible hose and means for selectively pressure loading the hose to an adjustable extent.

10. The headbox of claim 7, wherein the second, movable duct wall and the beam are pivotally mounted generally for pivoting in the same directions.

11. The headbox of claim 10, wherein the second duct wall and the beam pivot around respective axes which are at least approximately coaxial.

12. The headbox of claim 1, further comprising a pressure control device connected with the back pressure cushion for regulating the pressure in the back pressure cushion, and the pressure control device is for sensing the pressure of the fibrous stock suspension in the outlet duct and in turn for operating the back pressure cushion to apply pressure to the second duct wall so that forces acting on the second duct wall from the beam and the back pressure cushion and the stock suspension are counterbalanced in a selected manner.

13. The headbox of claim 12, wherein the pressure control device includes a sensor in the outlet duct for measuring the pressure of the stock suspension, and the pressure control device being connected with the sensor and being operable in response to the signal generated by the sensor to in turn control the pressure in the back pressure cushion.

14. The headbox of claim 13, further comprising a measuring device for measuring the clear width of the outlet slot and for transmitting to the pressure control device a signal responsive to the measured width of the outlet slot, and a regulating device connected with the pressure control device for maintaining the clear width of the outlet slot constant over time in response to a signal from the pressure control device to the regulating device.

15. The headbox of claim 2, further comprising means loosely connecting the beam and the movable duct, with the loosely connecting means permitting the beam to move with respect to the second wall in response to the action of the pressure cushion.

16. The headbox of claim 15, wherein the means connecting the beam and the second duct comprise jaw components extending from the beam to the second duct wall and engaging the second duct wall with sufficient free space that the second duct wall may move relative to the beam.

17. The headbox of claim 11, wherein the lifting appliance is so connected to the beam that, in a longitudinal section through the headbox, the lifting appliance has an effective curve that lies approximately in the effective curve of compression forces which force the back pressure cushion against the beam.

18. The headbox of claim 2, wherein at least one of the walls of the duct is comprised of a material having a coefficient of expansion of approximately zero.

19. The headbox of claim 18, wherein the second movable duct wall is comprised of a material having a coefficient of a thermal expansion of approximately zero.

20. The headbox of claim 18, wherein the first, relatively stationary duct wall is comprised of a material having a coefficient of a thermal expansion of approximately zero.

21. The headbox of claim 18, wherein the material of the at least one duct wall comprises a carbon fiber reinforced plastic material.

* * * * *